United States Patent [19]

Austin

[11] 4,344,537

[45] Aug. 17, 1982

[54] EXPANDABLE CARTON AND BLANK FOR FORMING SAME

[75] Inventor: John J. Austin, Elkhart, Ind.

[73] Assignee: Champion International Corporation, Stamford, Conn.

[21] Appl. No.: 125,153

[22] Filed: Feb. 27, 1980

[51] Int. Cl.[3] ..... B65D 17/20; B65D 17/24

[52] U.S. Cl. ..... 206/611; 206/607; 229/37 R; 229/41 B

[58] Field of Search ..... 229/37 R, 37 E, 41 B, 229/41 R; 206/607, 611, 427, 625, 624, 626

[56] References Cited

U.S. PATENT DOCUMENTS

| | | | |
|---|---|---|---|
| 3,526,353 | 9/1970 | Jaeschke | 206/607 |
| 3,580,478 | 5/1971 | Bemiss | 206/607 X |
| 4,129,248 | 12/1978 | Casutt | 229/41 B |
| 4,184,597 | 1/1980 | Gavin | 206/611 |
| 4,216,861 | 8/1980 | Oliff | 206/611 X |

*Primary Examiner*—George T. Hall

*Attorney, Agent, or Firm*—Evelyn M. Sommer

[57] ABSTRACT

An expandable carton and a blank for forming same has top and bottom panels which are coupled by a self-locking expanding arrangement along three respective side edges of the top and bottom panels. At the fourth side edges of the top and bottom panels, closure flaps are hingedly coupled to close and lock the carton in its expanded or assembled configuration. This permits the carton to be shipped and stored in essentially flat, collapsed configuration, and then easily assembled and closed by simple manual operations without gluing. The carton may be opened by a tear strip arrangement to gain access to the carton interior.

11 Claims, 10 Drawing Figures

EXPANDABLE CARTON AND BLANK FOR FORMING SAME

BACKGROUND OF THE INVENTION

The present invention relates to an expandable carton and a blank for forming the carton. More particularly, the invention relates to a carton and blank which has a self-locking expandable arrangement coupling the top and bottom panels of the carton and which may be easily closed and secured by closure flaps.

In certain industries, e.g., the fast food industry, cartons and containers for various articles must be shipped in a partially assembled, flat, collapsed configuration for efficient shipping and storage. Such carton or container must then be easily and quickly expanded or assembled, filled with the appropriate article and closed manually by unskilled personnel.

For the fast food industry, the carton needs a venting arrangement to permit steam to escape if the carton and article therein are heated. The carton must also be easily opened and usable as a plate or bowl.

It is also highly desirable that the carton and blank therefor be folded and glued in a simple and inexpensive manner prior to shipment in a flat, collapsed configuration.

SUMMARY OF THE INVENTION

Accordingly, it is an object of the present invention to provide a carton and a blank for forming a carton that may be quickly and simply converted from a partially assembled, collapsed configuration to an expanded or assembled configuration, filled, and closed without skilled personnel and without complex folding and gluing operations.

Another object of the present invention is to provide a carton and a blank for forming a carton which locks itself in its assembled and closed configurations.

An additional object of the present invention is to provide a carton and a unitary blank for forming a carton of rugged construction which is simple and inexpensive to manufacture, assemble and use.

A further object of the present invention is to provide a carton and a unitary blank for forming a carton which may be simply adapted to provide venting arrangement and a bowl configuration for the contents with an easy opening tear strip arrangement for gaining access to the contents.

The foregoing objects are attained by an expandable carton, comprising a top panel having first and second side edges and first and second end edges, a bottom panel having first and second side edges and first and second end edges, self-locking expandable means for coupling the first and second side edges and the first end edge of the top panel to the first and second side edges and first end edge of the bottom panel, respectively, a bottom closure flap hingedly coupled to the bottom panel at the second end edge thereof along a fold line, and a top closure flap hingedly coupled to the top panel at the second end edge thereof along a fold line.

The foregoing objects are also obtained by a planar unitary blank for forming an expandable carton comprising a top panel having first and second side edges and first and second end edges, a bottom panel having first and second side edges and first and second end edges, a bottom closure flap hingedly coupled to the bottom panel at the second end edge thereof along a fold line, a top closure flap hingedly coupled to the top panel at the second end edge thereof along a fold line, first and second trapezoidal top side panels hingedly coupled to the top panel at the first and second side edges thereof, respectively, along fold lines, first and second trapezoidal bottom side panels hingedly coupled to the bottom panel at first and second side edges thereof, respectively, along fold lines, first and second glue flaps hingedly coupled to one of the first and second side panels, respectively, at side edges thereof remote from one of the top and bottom panels along fold lines, top and bottom end panels hingedly coupled to the first end edges of the top and bottom panels, respectively, along fold lines, the top and bottom end panels being hingedly coupled at edges remote from the top and bottom panels, respectively, along a fold line, first and second triangular top corner panels hingedly coupled to the top end panel at opposite side edges thereof along fold lines and to the first and second top side panels, respectively, at side edges thereof along fold lines, first and second triangular bottom corner panels hingedly coupled to the bottom end panel at opposite side edges thereof along fold lines and to the first and second bottom side panels, respectively, at said edges thereof along fold lines, the first and second top corner panels being hingedly coupled to the first and second bottom corner panels, respectively, along folds lines, third and fourth triangular top corner panels hingedly coupled to the top closure flap at opposite side edges thereof along fold lines and to the first and second top side panels, respectively, at side edges thereof remote from the first and second top corner panels along fold lines, and third and fourth triangular bottom corner panels hingedly coupled to the bottom closure flap at opposite side edges thereof along fold lines and to the first and second bottom side panels at side edges thereof remote from the first and second bottom corner panels along fold lines.

By forming the carton and blank of the present invention in this manner, the carton may be partially formed in a simple and inexpensive manner, and shipped in a flat, collapsed configuration. The carton may then be easily and simply expanded to a fully assembled configuration, filled with the appropriate article and closed. The closed and filled carton is self-locking and retains its shape to protect the contents from temperature change, contamination or other damage. The assembling, filling and closing operations of the carton are accomplished by simple hand manipulation of the partially assembled carton without gluing, or skilled personnel. Thus, the present invention permits expandable cartons to be easily and economically manufactured, shipped, stored and used.

Other objects, advantages and salient features of the present invention will become apparent from the following detailed description, which, taken in conjunction with the annexed drawings, discloses a preferred embodiment of the present invention.

As used in this application, the terms, "first," "second," "third," "fourth," "top," "bottom," "side" and "end," are intended to facilitate the description of the carton and the blank for forming the carton. Thus, such terms are merely illustrative of the carton and blank and are not intended to limit the carton or blank to any specific orientation.

BRIEF DESCRIPTION OF THE DRAWINGS

Referring to the drawings which form a part of this original disclosure.

DETAILED DESCRIPTION OF THE PREFERRED EMBODIMENT OF THE INVENTION

Figure 1:
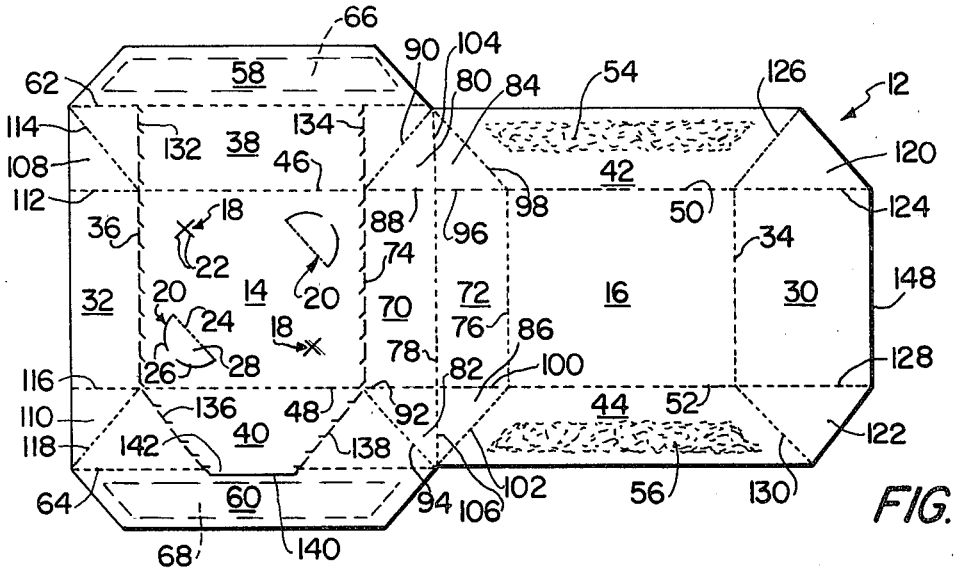
FIG. 1 is a top plan view illustrating the interior surface of a blank for forming a carton in accordance with the present invention.

Referring to FIG. 1, the blank 12 may be formed of a unitary, planar piece of paperboard of suitable weight and thickness. The weight and thickness of the paper depends on the size and weight of the article contained within the carton. FIG. 1 illustrates the surface which will form the interior surface of the carton.

The majority of the central portion of the blank 12 comprises a top panel 14 and a bottom panel 16. Each of the panels 14, 16 is rectangular and bounded by two side edges and two end edges.

The top planel 14 has two pairs of vents 18, 20 formed therein. Each of the vents 18 comprises a pair of relatively short perpendicular slits that cross at their midpoints. Each of the vents 20 comprises a fold line 24 and two arcuate slits 26 extending from opposite ends of the fold line 24. The slits 26 are separated by a portion of the top panel 14 which is left intact. The fold line 24 and the slits 26 define a vent flap 28 in the form of a sector with a 180° included angle.

Rectangular closure flaps 30, 32 are hingedly coupled at opposed end edges of the bottom and top panels 16, 14, respectively. The bottom closure flap 30 is hingedly coupled to the bottom panel 16 along fold line 34. The top closure flap 32 is hingedly coupled to the top panel 14 along the fold line 36.

Side panels 38, 40, 42, 44 extend from opposite side edges of the top panel 14 and the bottom panel 16. Each of these side panels is in the form of an isosceles trapezoid with its smaller base attached to a respective side edge of one of the top or bottom panels 14, 16. The first top side panel 38 is hingedly coupled to the top panel 14 along fold line 46. The second top side panel 40 is hingedly coupled to the top panel 14 along fold line 48. The first bottom side panel 42 is hingedly coupled to the bottom panel 16 along fold line 50. The second bottom side panel 44 is hingedly coupled to the bottom panel 16 along fold line 52. Glue areas 54, 56 are provided on the interior surfaces of the first and second bottom side panels 42, 44, respectively.

Glue flaps 58, 60 extend from opposite side edges of the first and second top side panels 38, 40 remote from the top panel 14. The glue flaps 58, 60 are in the form of isosceles trapezoids with their longer bases attached to the side panels 38, 40, respectively. The first glue flap 58 is hingedly coupled to the first top side panel 38 along fold line 62. The second glue flap 60 is hingedly coupled to the second top side panel 40 along the fold line 64. Glue areas 66, 68 are formed on the exterior surface of the glue flaps 58, 60 and are shaped and arranged to mate with the glue areas 54, 56 on the side panels 42, 44.

The remaining, adjacent end edges of the top and bottom panels 14, 16 have rectangular top and bottom end panels 70, 72, respectively, attached thereto. The top end panel 70 is hingedly coupled to the top panel 14 along the fold line 74. The bottom end panel 72 is hingedly coupled to the bottom panel 16 along the fold line 76. The end panels 70, 72 are hingedly coupled together at edges thereof remote from the top and bottom panels 14, 16 along the fold line 78. The sum of the dimensions of the end panels 70, 72 in a direction perpendicular to the fold line 78 substantially equals the dimension of the bottom closure flap 30 in a direction perpendicular to the fold line 34.

Top corner panels 80, 82 connect respective side edges of the top end panel 70 to the top side panels 38, 40. Similarly, bottom corner panels 84, 86 connect respective side edges of the bottom end panel 72 and the bottom side panels 42, 44. The first top corner panel 80 is hingedly coupled to the top end panel 70 along fold line 88 and to the first top side panel 38 along fold line 90. The second top corner 82 is hingedly coupled to the top end panel 70 along fold line 92 and to the second top side panel 40 along fold line 94. The first bottom corner panel 84 is hingedly coupled to the bottom end panel 72 along fold line 96 and to the first bottom side panel 42 along fold line 98. The second bottom corner panel 86 is hingedly coupled to the bottom end panel 72 along fold line 100 and to the second bottom side panel 44 along fold line 102. The corner panels 80, 84 are hingedly coupled along fold line 104, while corner panels 82, 86 are hingedly coupled along fold line 106.

These corner panels are in the form of a right isosceles triangles, with sides formed by fold lines 88, 104, 96, 92, 106, 100 and hypotenuses provided by fold lines 90, 98, 94, 96.

Third and fourth top corner panels 108, 110 connect the top closure flap 32 to the top side wall panels 38, 40, respectively. The third top corner 108 is hingedly coupled to the top closure flap 32 along fold line 112 and to the first top side panel 38 along fold line 114. The fourth top corner panel 110 is hingedly coupled to the top closure flap 32 along fold line 116 and to the second top side panel 40 along fold line 118. The corner panels 108, 110 are in the form of right triangles with fold lines 114, 118, respectively, forming the hypotenuses thereof.

The bottom closure flap 30 is coupled to the bottom side panels 42, 44 by triangular third and fourth bottom corner panels 120, 122. The third bottom corner panel 120 is hingedly coupled to the bottom closure flap 30 along fold line 124 and to the first bottom side panel 42 along fold line 126. The fourth bottom corner panel 122 is hingedly coupled to the bottom closure flap 30 along fold line 128 and to the second bottom side panel 44 along fold line 130.

In this manner, the third and fourth top corner panels 108, 110 are hingedly coupled to the top closure flap 32 at opposite side edges thereof and to the top side panels 38, 40 at side edges thereof remote from the first and second top corner panels 80, 82. Also, the third and fourth bottom corner panels 120, 122 are hingedly coupled to the bottom closure flap 30 at opposite side edges thereof and to the first and second bottom side panels 42, 44 at side edges thereof remote from the first and second bottom corner panels 84, 86.

In order to provide a means of easily opening the carton formed from the blank 12, a plurality of perforated lines are provided. These perforated lines comprise a series of perforations, with each perforation comprising a longer line portion along the direction of intended tearing and a shorter line portion at an obtuse angle thereto. The first perforated line 132 extends perpendicularly from the fold line 62, through the first top side panel 38 to the juncture of fold lines 46, 112, 114 and along the entire length of the fold line 36 terminating at the junction of the fold lines 48, 116, 118. The first perforated line 132 forms the fold line 36 between the top closure flap 32 and the top panel 14. The second perforated line 134 extends perpendicularly from the fold line 62, through the first top side panel 38 and the juncture of fold lines 46, 88, 90, and along the fold line 74 terminating at the juncture of fold lines 48, 92, 94. The second perforated line 134 forms the fold line 74 between the top panel 14 and the top end panel 70. The use of portions of lines 132, 134 to form fold lines 36, 74 eliminates the formation of two fold lines, thereby simplifying the manufacture of the blank 12.

Third and fourth perforated lines 136, 138 are formed in the second top side panel 40 and extend at obtuse angles from the ends of the perforated lines 132, 134, respectively. The third and fourth perforated lines 136, 138 terminate at fold line 64 in a generally U-shaped slit 140 formed in the second glue flap 60. The U-shaped slit 140 forms a lifting tab 142 as will be explained in more detail hereinafter. The U-shaped slit 140, perforated lines 132, 134, 136, 138, and fold line 62 define a tear strip portion of the carton.

Figure 2:
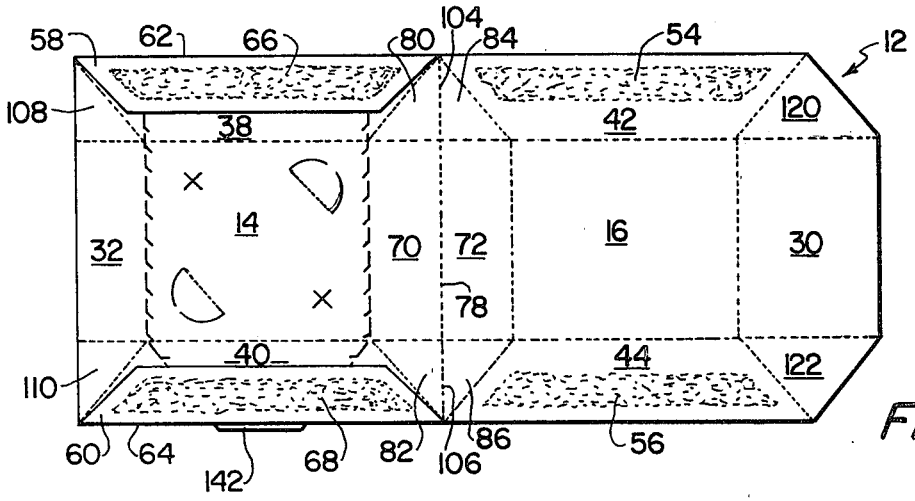
FIG. 2 is a top plan view illustrating the blank of FIG. 1 in an intermediate folding and gluing stage.

The carton 144 (illustrated in FIGS. 4 and 5) is formed from the blank 12 of FIG. 1 by folding the glue flaps 58, 60 about fold lines 62, 64, respectively until the glue flaps lie against the interior surfaces of the top side panels 38, 40, respectively, as seen in FIG. 2. The folding of glue flap 60 causes the lifting tab 142 to separate from the remainder of the flap 60 along slit 140 and to extend from the edge formed by fold line 64. The remainder of the flaps and panels are left coplanar as illustrated in FIG. 2.

Thereafter, the blank 12 is folded about the colinear fold lines 104, 78, 106 until the glue flaps 58, 60 lie against the interior surface of the bottom side panels 42, 44, respectively. This causes the adhesive applied to the glue area 66 and/or glue area 54 to secure the glue flap 58 to the bottom side panel 42 and the adhesive applied to glue area 68 and/or glue area 56 to adhere the glue flap 60 to the second bottom side panel 44.

Figure 3:
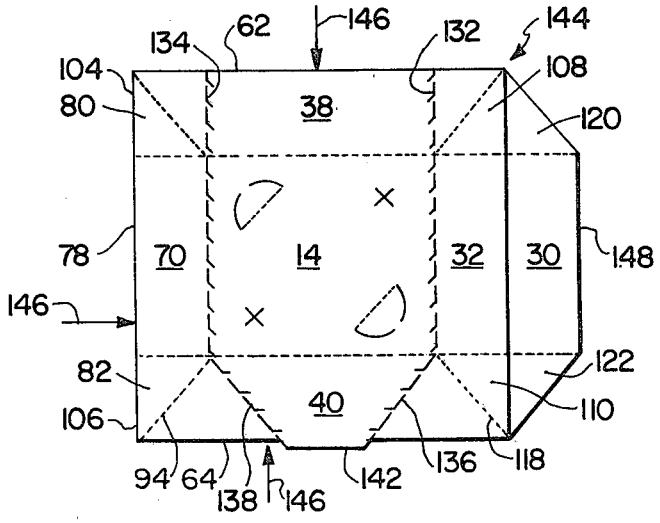
FIG. 3 is a top plan view illustrating the blank of FIG. 1 after it has been folded and glued in its partially assembled, collapsed configuration.

The blank 12 is now in the flat, collapsed configuration of the carton 144 illustrated in FIG. 3. In this configuration, panels 14, 38, 40, 70, 80, 82, 108, 110 and flap 32 are coplanar, and panels 16, 42, 44, 72, 84, 86, 120, 122 and flap 30 are coplanar. It is in this flat, collapsed configuration that the carton may be efficiently shipped and stored.

Figure 4:
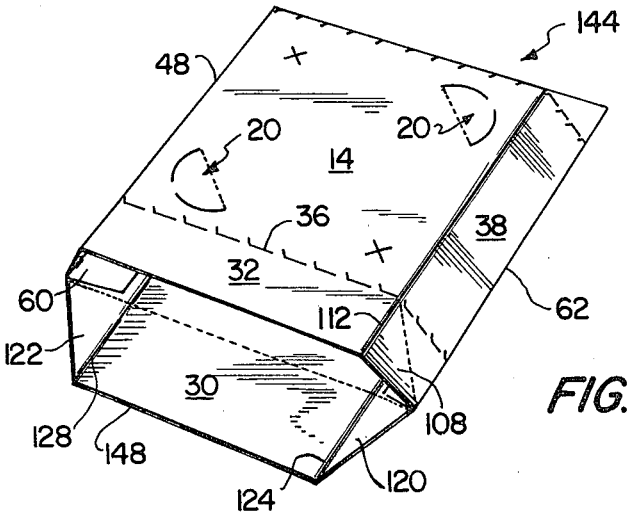
FIG. 4 is a perspective view illustrating a carton according to the present invention in its assembled, open configuration.
Figure 5:
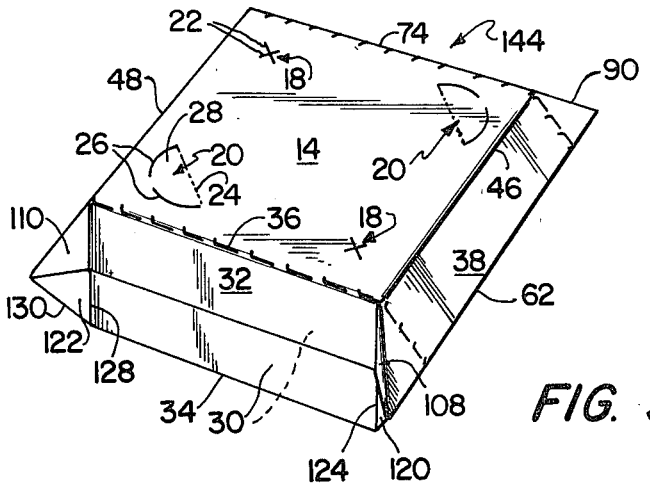
FIG. 5 is a perspective view illustrating the carton of FIG. 5 in its assembled, closed configuration.

The fully assembled, open configuration of FIG. 4 is formed from the partially assembled, collapsed configuration of FIG. 3 by applying inwardly directed forces against the side edges (i.e., fold lines 62, 64) and the left hand end edge (i.e., fold line 78) of the FIG. 3 configuration. These forces cause the carton 144 to expand or open up with the top and bottom panels 14, 16 separating by expansion of the self-locking expansion means comprising the side panels 38, 40, 42, 44, the glue flaps 58, 60, the end panels 70, 72, and the corner panels 80, 82, 84, 86.

Figure 8:
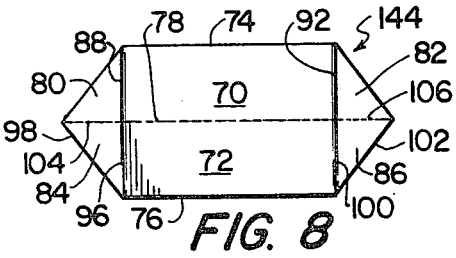
FIG. 8 is a rear elevational view of the carton of FIG. 5.
Figure 9:
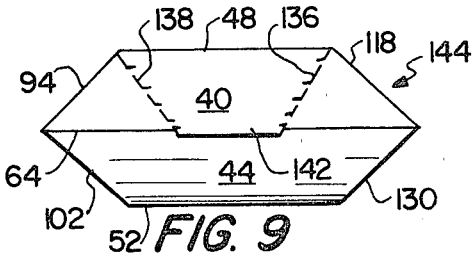
FIG. 9 is a left side elevational view of the carton of FIG. 5.

In expanding or opening, the side panels 38, 42 pivot about fold lines 62 and the side panels 40, 44 pivot about fold line 64 until the adjacent side panels are oriented at an approximately 90° angle. Additionally, the end panels 70, 72 pivot about fold lines 74, 76, 78 until they are coplanar and they are perpendicular to the top and bottom panels 14, 16. The movement of panels 70, 72 causes the corner panels 80, 84 and corner panels 82, 86 to pivot about fold lines 104, 106, respectively, and to pivot about fold lines 88, 96 and 92, 100, respectively, until corner panels 80, 84 are coplanar, corner panels 82, 86 are coplanar, and each of these corner panels are in planes oriented at obtuse angles to the plane of the end panels 70, 72. The movement of end panels 70, 72 and corner panels 80, 82, 84, 86 locks the carton 144 in its expanded or assembled configuration as illustrated in FIG. 8. The corner panels 108, 110 pivot about fold lines 112, 116, respectively, to remain coplanar with the top side panels 38, 40, respectively. The corner panels 120, 122 pivot about fold lines 124, 128, respectively, to remain coplanar with bottom side panels 42, 44, respectively.

In this open configuration illustrated in FIG. 4, the top closure flap 32 remains coplanar with the top panel 14 and the bottom closure flap 30 remains coplanar with the bottom planel 16. The flaps 30, 32 and panels 108, 110, 120, 122 in this position form a scoop or mouth to facilitate filling of the carton.

When the carton 144 is in the open position illustrated in FIG. 4, the article to be enclosed therein may be simply inserted by sliding the bottom closure flap 30 under such article and continuing to slide the article into the carton 144. Once the article is centrally located on the bottom panel 16, the carton is ready to be closed.

Figure 6:
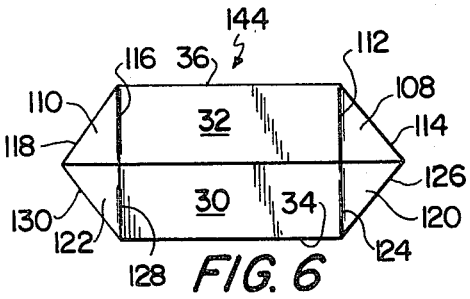
FIG. 6 is a front elevational view of the carton of FIG. 5.
Figure 7:
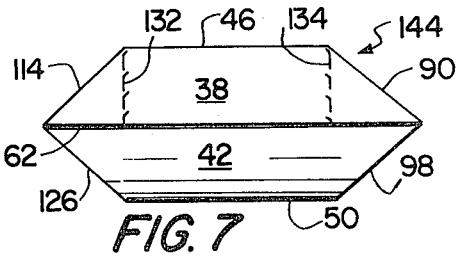
FIG. 7 is a right side elevational view of the carton of FIG. 5.

The filled carton is closed by first pivoting the bottom closure flap 30 about fold line 34 until the closure flap 30 is perpendicular to the bottom panel 16 and the free edge 148 of the flap 30 is adjacent the fold line 36. The pivoting of the closure flap 30 causes the corner panels 120, 122 to pivot about fold lines 124, 126 and 128, 130, respectively, to the position illustrated in FIGS. 5 and 6. Since the height of the closure flap 30 in this position is equal to the sum of the heights of the end panels 70, 72 in this position, the top and bottom panels 14, 16 will be parallel.

Once the bottom closure flap 30 is in place, the top closure flap 32 is pivoted about fold line 36 until it overlies the outer surface of the bottom closure flap 30. The pivoting of the top closure flap 32 causes the corner panels 108, 110 to pivot about fold lines 112, 114 and 116, 118, respectively to the position illustrated in FIGS. 5 and 6. This completes assembly of the carton 144 and locks it in its fully assembled closed position.

The article contained within this carton is now protected from the elements and sealed so as to retain it at the appropriate temperature.

If the carton 144 and the article contained therein is placed in a heated environment and the article would emit steam upon heating, then the vents 18, 20 should be opened. The opening of the vents 18, 20 permits steam to escape to prevent the article from becoming soggy. The vents 18 are opened by pushing inwardly at the juncture of the slits 22 to force the adjacent portions of the top panel 14 inwardly, thereby forming an opening in the top panel. If larger openings are necessary, the vents 20 may be opened. Vents 20 are opened by pressing downwardly on the vent flaps 28 to sever the portion of the top panel 14 located between the free ends of the slits 26. These forces also cause the vent flaps 28 to pivot about the fold lines 24 into the interior of the carton, thereby forming openings in the top panel to release steam.

Figure 10:
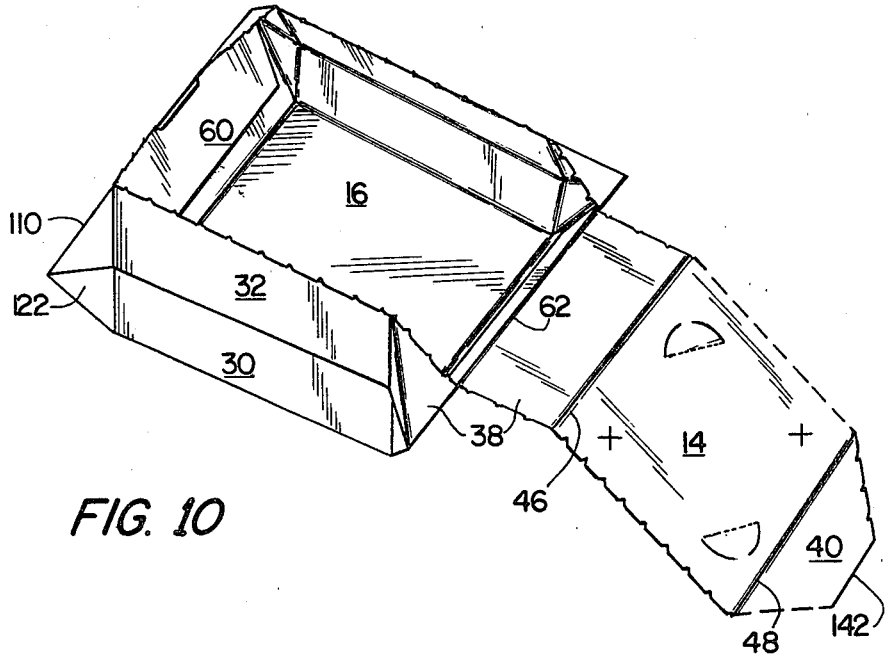
FIG. 10 is a perspective view illustrating the carton of FIG. 5 opened for removal of its contents.

The carton is opened to remove the article by grasping the lifting tab 142 which extends outwardly from the side edge (i.e., fold line 64) of the carton 144. The lifting tab 142 is lifted to sever the material of the carton along the perforated lines 136, 138 and 132, 134. Thereafter, the tear strip portion of the carton defined by the locking tab 142, the perforated lines 136, 138, 132, 134 and the fold line 62 is pivoted completely out of the way about fold line 62 as illustrated in FIG. 10. This permits the carton to be used as a dish or a bowl in consuming the article since the bottom half of the carton does not have any split seams.

Once the article has been consumed, the article may be again collapsed generally to the configuration of that illustrated in FIG. 3 by opening the closure flaps 30, 32 and pressing the top and bottom panels 14, 16 together. Collapsing the carton 144 after consumption of the article permits efficient disposal of the carton.

By forming and folding the blank 12 and the carton 144 in this manner, the carton 144 may be shipped in a substantially flat, collapsed configuration. The flat, collapsed carton 144 may then be quickly and simply expanded and locked in place by simple manual operations of unskilled personnel without gluing. Additionally, the carton 144 may be closed by a simple manual operation without gluing. The carton 144 also may be provided with vents to permit steam to escape and with an easy opening tear strip arrangement to gain access to the carton interior. The manufacture of the carton 144 to its flat, collapsed configuration is facilitated by the simple gluing arrangement.

While a particular embodiment has been chosen to illustrate the invention, it will be understood by those skilled in this art that various changes and modifications can be made therein without departing from the scope of the invention as defined in the appended claims.

What is claimed is:

1. An expandable carton, comprising:

a top panel having first and second side edges and first and second end edges;

a bottom panel having first and second side edges and first and second end edges;

self-locking expandable means for coupling said first and second side edges and said first end edge of said top panel to said first and second side edges and said first end edge of bottom panel, respectively;

a bottom closure flap hingedly coupled to said bottom panel at said second end edge thereof along a fold line; and a top closure flap hingedly coupled to said top panel at said second end edge thereof along a fold line.

2. An expandable carton according to claim 1, wherein said expandable means comprises:

first and second top side panels hingedly coupled to said top panel at said first and second side edges thereof, respectively, along fold lines;

first and second bottom side panels hingedly coupled to said bottom panel at said first and second side edges thereof, respectively, along fold lines, said first and second top side panels being hingedly coupled to said first and second bottom side panels, respectively, at edges thereof remote from said top and bottom panels along fold lines;

top and bottom end panels hingedly coupled to said first end edges of said top and bottom panels, respectively, along fold lines, said top and bottom panels hingedly coupled at edges remote from said top and bottom panels, respectively, along a fold line.

3. An expandable carton according to claim 2, wherein said expandable means further comprises:

first and second top corner panels hingedly coupled to said top end panel at opposite side edges thereof along fold lines and to said first and second top side panels, respectively, at side edges thereof along fold lines;

first and second bottom corner panels hingedly coupled to said bottom end panel at opposite side edges thereof along fold lines and to said first and second bottom side panels, respectively, at side edges thereof along fold lines, said first and second top corner panels being hingedly coupled to said first and second bottom corner panels, respectively, along fold lines;

third and fourth top corner panels hingedly coupled to said top closure flap at opposite side edges thereof along fold lines and to said first and second top side panels, respectively, at side edges thereof remote from said first and second top corner panels along fold lines; and third and fourth bottom corner panels hingedly coupled to said bottom closure flap at opposite side edges thereof along fold lines and to said first and second bottom side panels, respectively at side edges thereof remote from said first and second bottom corner panels along fold lines.

4. An expandable carton according to claim 3, wherein said corner panels are triangular.

5. An expandable carton according to claim 3, wherein said side panels are trapezoidal.

6. An expandable carton according to claim 2, wherein the dimension of said bottom closure flap in a direction perpendicular to the fold line joining said bottom closure flap and said bottom panel is substantially equal to the sum of the dimensions of said end panels in a direction perpendicular to the fold line hingedly coupling said end panels.

7. An expandable carton according to claim 2, wherein a first glue flap is hingedly coupled to one of said first side panels at an edge thereof remote from one of said top and bottom panels along a fold line and is secured to a surface of the other of said first side panels; and a second glue flap is hingedly coupled to one of said second side panels at an edge thereof remote from one of said top and bottom panels along a fold line and is secured to a surface of the other of said second side panels.

8. An expandable carton according to claim 1, wherein said top panel includes vent means.

9. An expandable carton according to claim 1, wherein said top panel includes a plurality of perforated lines defining a tear strip for opening the carton.

10. A planar, unitary blank for forming an expandable carton, comprising:

a top panel having first and second side edges and first and second end edges;

a bottom panel having first and second side edges and first and second end edges;

a bottom closure flap hingedly coupled to said bottom panel at said second end edge thereof along a fold line;

a top closure flap hingedly coupled to said top panel at said second end edge thereof along a fold line;

first and second trapezoidal top side panels hingedly coupled to said top panel at said first and second side edges thereof, respectively, along fold lines;

first and second trapezoidal bottom side panels hingedly coupled to said bottom panel at said first and second side edges thereof, respectively, along fold lines;

first and second glue flaps hingedly coupled to one of said first and second side panels, respectively, at edges thereof remote from one of said top and bottom panels along fold lines;

top and bottom end panels hingedly coupled to said first end edges of said top and bottom panels, respectively, along fold lines, said top and bottom end panels hingedly coupled at edges remote from said top and bottom panels, respectively, along a fold line;

first and second triangular top corner panels hingedly coupled to said top end panel at opposite side edges thereof along fold lines and to said first and second top side panels, respectively, at side edges thereof along fold lines;

first and second triangular bottom corner panels hingedly coupled to said bottom end panel at opposite side edges thereof along fold lines and to said first and second bottom side panels, respectively, at side edges thereof along fold lines, said first and second top corner panels being hingedly coupled to said first and second bottom corner panels, respectively, along fold lines;

third and fourth triangular top corner panels hingedly coupled to said top closure flap at opposite side edges thereof along fold lines and to said first and second top side panels, respectively, at side edges thereof remote from said first and second top corner panels along fold lines; and third and fourth triangular bottom corner panels hingedly coupled to said bottom closure flap at opposite side edges thereof along fold lines and to said first and second bottom side panels, respectively, at side edges thereof remote from said first and second bottom corner panels along fold lines.

11. A planar, unitary blank according to claim 10, wherein the dimension of said bottom closure flap in a direction perpendicular to the fold line joining said bottom closure flap and said bottom panel is substantially equal to the sum of the dimensions of said end panels in a direction perpendicular to the fold line hingedly coupling said end panels.

* * * * *